US008192585B2

(12) United States Patent
Nakagawa et al.

(10) Patent No.: US 8,192,585 B2
(45) Date of Patent: Jun. 5, 2012

(54) SHOE PRESS BELT

(75) Inventors: Keiji Nakagawa, Kyoto (JP); Tetsuya Murakami, Hirakata (JP)

(73) Assignee: Yamauchi Corporation, Osaka (JP)

( * ) Notice: Subject to any disclaimer, the term of this patent is extended or adjusted under 35 U.S.C. 154(b) by 438 days.

(21) Appl. No.: 12/520,418

(22) PCT Filed: Dec. 12, 2007

(86) PCT No.: PCT/JP2007/073929

§ 371 (c)(1),
(2), (4) Date: Jun. 19, 2009

(87) PCT Pub. No.: WO2008/078558

PCT Pub. Date: Jul. 3, 2008

(65) Prior Publication Data

US 2010/0032121 A1 Feb. 11, 2010

(30) Foreign Application Priority Data

Dec. 22, 2006 (JP) ..... 2006-346671

(51) Int. Cl.
*D21F 3/02* (2006.01)

(52) U.S. Cl. ..... 162/358.4; 162/901

(58) Field of Classification Search ..... 162/306, 162/358.2, 358.4, 900–903, 358.1, 358.3
See application file for complete search history.

(56) References Cited

U.S. PATENT DOCUMENTS

| | | | | |
|---|---|---|---|---|
| 4,625,376 | A | 12/1986 | Schiel et al. | |
| 6,835,286 | B2 * | 12/2004 | Honkalampi et al. | 162/358.3 |
| 2002/0060052 | A1 | 5/2002 | Best | |
| 2005/0115100 | A1 * | 6/2005 | Fitzpatrick et al. | 34/400 |

FOREIGN PATENT DOCUMENTS

| | | | |
|---|---|---|---|
| JP | 61179359 | A | 8/1986 |
| JP | 11012975 | A | 1/1999 |
| JP | 2003171891 | A | 6/2003 |
| JP | 2004131891 | A | 4/2004 |
| WO | 02090649 | A1 | 11/2002 |
| WO | 03085195 | A1 | 10/2003 |
| WO | 2005028748 | A1 | 3/2005 |
| WO | 2005075736 | A2 | 8/2005 |
| WO | 2006059530 | A1 | 6/2006 |
| WO | 2006093090 | A1 | 9/2006 |

OTHER PUBLICATIONS

International Search Report, PCT/JP2007/073929, Feb. 5, 2008, pp. 18-23.

* cited by examiner

*Primary Examiner* — Eric Hug
(74) *Attorney, Agent, or Firm* — Ditthavong Mori & Steiner, P.C.

(57) ABSTRACT

A press belt 20 includes a multiplicity of drain grooves 21 extending along a belt travel direction, lands 22 located between adjacent drain grooves 21, and auxiliary grooves 23 located on the lands 22 and extending along the belt travel direction. A transverse sectional area of each auxiliary groove 23 is smaller than that of each drain groove 21.

10 Claims, 4 Drawing Sheets

SHOE PRESS BELT

TECHNICAL FIELD

The present invention relates to a shoe press belt for use in a pressing/dehydrating process of a wet paper web in the paper manufacturing industry.

BACKGROUND ART

A shoe press is a pressing (dehydrating) method in which an object to be pressed (wet paper web) is placed on the outer periphery of a press belt, and a surface pressure is applied to the object between a press roll positioned outside the periphery of the press belt and serving as external pressing means and a pressure shoe positioned inside the periphery of the press belt and serving as internal pressing means, through the press belt. While a roll press for performing pressing with two rolls applies a linear pressure to an object to be pressed, the shoe press can apply a surface pressure to the object to be pressed by using the pressure shoe having a predetermined width in a travel direction. Thus, performing a dehydrating press with the shoe press is advantageous in that a nip width can be increased and dehydrating efficiency can be improved.

In order to make the shoe press compact, a shoe press roll in which a pressure shoe serving as internal pressing means is covered with a flexible cylindrical press belt (press jacket) and assembled into a roll shape has been widely used as disclosed in, e.g., Japanese Patent Publication No. S61-179359 of unexamined applications.

General required characteristics for the press belt include strength, abrasion resistance, flexibility, and impermeability to water, oil, gas, and the like. Polyurethane, which is obtained by a reaction between a urethane prepolymer and a curing agent, has been commonly used for the press belt as a material having these characteristics.

In a papermaking technique, it has been known to form a multiplicity of drain grooves, extending along a belt travel direction, in the outer surface of the press belt in order to drain water squeezed from a pressed wet paper web.

FIG. 1 is a cross-sectional view showing a conventional typical press belt having drain grooves. A press belt 80 shown in the figure includes a multiplicity of drain grooves 81 extending along a belt travel direction, and a multiplicity of lands each positioned between adjacent drain grooves and extending along the belt travel direction. The size of the press belt 80 is generally as follows. The circumference is about 1 to 30 m, the width is about 2 to 15 m, and the thickness is about 2 to 10 mm.

FIG. 2 shows a state in which a wet paper web 84 to be pressed and a felt 83 are interposed between the press belt 80 and a press roll 85. This state is a state before pressing. An upper surface of each land 82 is flat, and this flat upper surface is in surface contact with the felt 83.

When a pressing operation is performed from the state shown in FIG. 2, an upper part of each land 82 is pressed downward and swells sideways as shown in FIG. 3. This reduces the size of the opening of each drain groove 81, thereby reducing the water squeezing performance (draining performance). If a permanent set occurs due to repeated pressure deformation, the drain grooves 81 become wide in the bottom and narrow in the opening or in the middle part, making it more difficult to drain the water entering the drain grooves 81. This results in so-called "water recirculation," i.e., a phenomenon in which the press belt 80 containing water comes in contact with a wet paper web again. When such s phenomenon occurs, water cannot be squeezed from a wet paper web, and the paper is further moistened (remoistening).

The above problem results from the fact the lands are compressed and swell sideways by pressing, and the drain grooves are deformed. There is another problem. This problem will be described below with reference to FIG. 4.

FIG. 4 shows a state in which the felt 83 and the wet paper web 84 are placed on the press belt 80. As shown by arrows in the figure, water contained in the wet paper web 84 and the felt 83 located in the most region is squeezed into the drain grooves 81. However, due to a long distance from a region A located in the middle part of each land 82 to an adjacent drain groove 81, water is not sufficiently squeezed from the wet paper web 84 and the felt 83 located in the regions A. This causes non-uniformity in moisture distribution and fiber orientation in the wet paper web 84, which may adversely affect the paper quality. It is possible to increase the number of drain grooves 81 in order to sufficiently squeeze water in the regions A as well. In this case, however, the surface area of the lands 82 becomes too small, and the load is concentrated on the small area, whereby the pressure deformation of the lands 82 shown in FIG. 3 becomes more significant. As a result, not only the water squeezing property is not improved, but also the lands 82 themselves tend to break due to insufficient strength.

DISCLOSURE OF THE INVENTION

The present invention was developed to solve the above problems, and it is an object of the present invention to provide a shoe press belt with excellent water squeezing performance.

It is another object of the present invention to provide a shoe press belt capable of maintaining excellent draining performance of drain grooves by reducing deformation of the drain grooves.

It is a further object of the present invention to provide a shoe press belt capable of squeezing water in a desirable manner even from a wet paper web portion located on a middle part of each land, and capable of manufacturing high quality paper.

A shoe press belt according to the present invention has a rotating endless shape, and includes a multiplicity of drain grooves extending along a belt travel direction, a plurality of lands located between adjacent ones of the drain grooves, and a plurality of auxiliary grooves located on each land and extending along the belt travel direction. A transverse sectional area of each auxiliary groove is smaller than that of each drain groove.

In one embodiment of the present invention, the auxiliary grooves have such a groove shape that tends to be deformed under pressure, in order to suppress deformation of the drain grooves.

In the above embodiment, provided that A is a width dimension of the drain grooves, B is a width dimension of the auxiliary grooves, C is a width dimension of the lands, D is a depth of the drain grooves, and E is a depth of the auxiliary grooves, a preferable dimensional relation is any one of the following relations, or any combination of the following relations.

$$0.3 \leqq B/A \leqq 0.8$$

$$0.15 \leqq B/C \leqq 0.35$$

$$0.6 \leqq E/D \leqq 1.4$$

Moreover, in the above embodiment, it is preferable that the drain grooves have a bottom with a downwardly concave circular-arc cross section, and the auxiliary grooves have a bottom with a rectangular cross section, in order to suppress deformation of the drain grooves and to facilitate deformation of the auxiliary grooves.

In another embodiment of the present invention, the auxiliary grooves have such a shape that can ensure a drain flow path even under pressure, in order to provide a draining function.

In the above embodiment, provided that A is a width dimension of the drain grooves, B is a width dimension of the auxiliary grooves, C is a width dimension of the lands, D is a depth of the drain grooves, and E is a depth of the auxiliary grooves, a preferable dimensional relation is any one of the following relations, or any combination of the following relations.

$$0.4 \leqq B/A \leqq 1$$

$$0.15 \leqq B/C \leqq 0.45$$

$$0.3 \leqq E/D \leqq 0.8$$

Moreover, in the above embodiment, it is preferable that the drain grooves have a bottom with a downwardly concave circular-arc cross section, and the auxiliary grooves have a semicircular transverse section, in order to suppress deformation of the drain grooves and the auxiliary grooves.

Functions and effects of the contents defined above will be described in the section described below.

BEST MODE FOR CARRYING OUT THE INVENTION

The inventor of the present invention observed how drain grooves were deformed by applying a pressure to a press belt.

Figure 1:
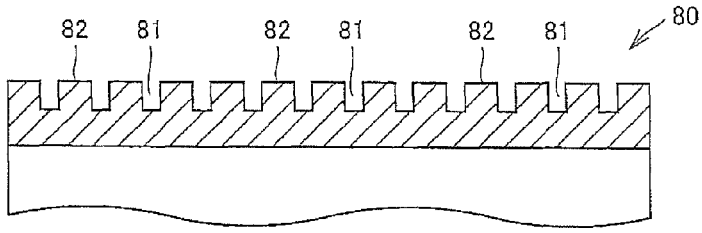
FIG. 1 is a cross-sectional view of a conventional papermaking press belt having drain grooves.
Figure 2:
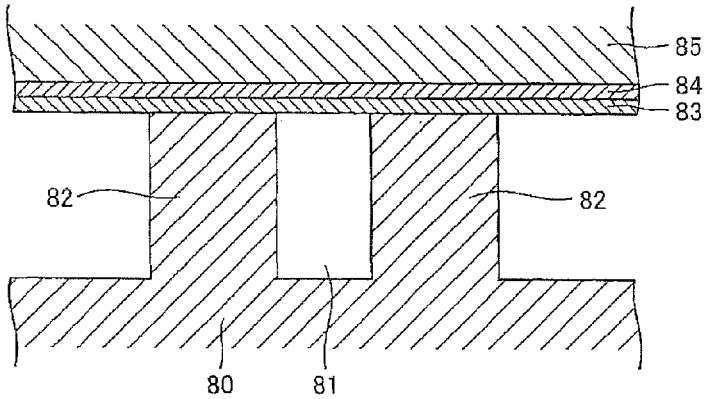
FIG. 2 is a cross-sectional view showing a state of the conventional press belt right before pressing.
Figure 3:
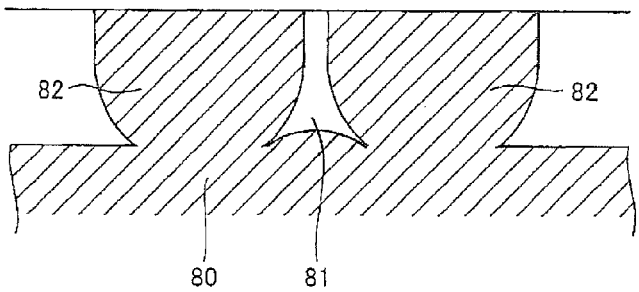
FIG. 3 is a cross-sectional view showing a pressed state of the conventional press belt.
Figure 4:
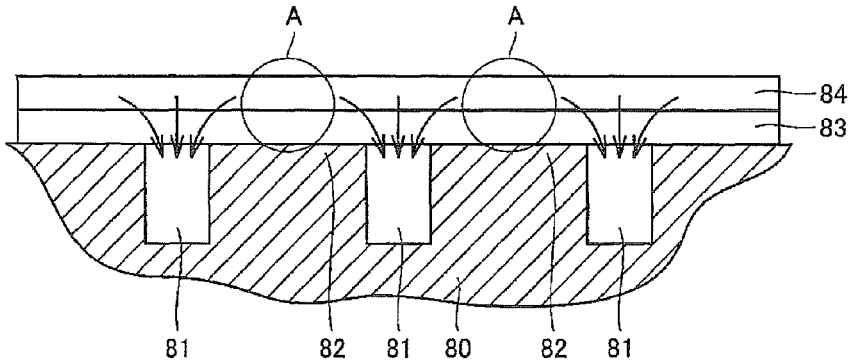
FIG. 4 is an illustration showing how the conventional press belt squeezes water.
Figure 5:
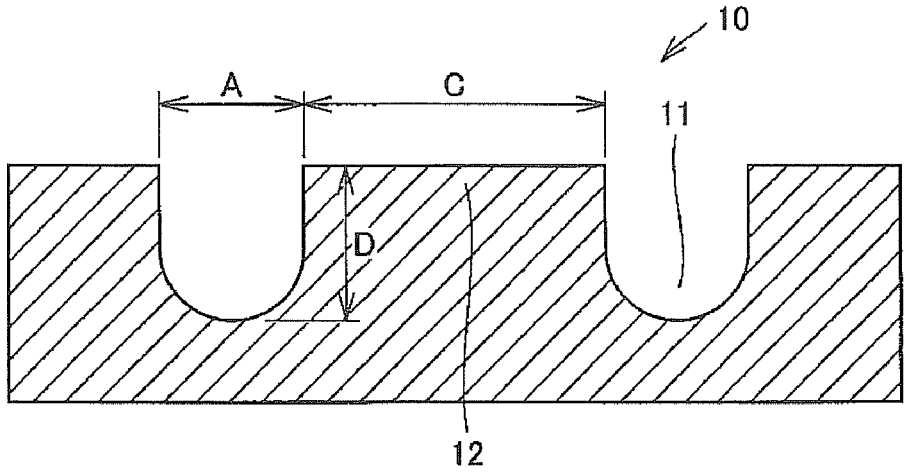
FIG. 5 is an illustrative cross-sectional view showing a state of a conventional press belt before pressing.

FIG. 5 is a cross-sectional view of a conventional press belt 10. The press belt 10 had a circumference of 404 mm, and an overall width dimension of 6,761 mm. The press belt 10 is made of polyurethane having a durometer hardness of A93, and has a multiplicity of drain grooves 11, and lands 12 each located between adjacent drain grooves 11. The drain grooves 11 had a width dimension of 1.0 mm, the lands 12 had a width dimension of 2.2 mm, and the drain grooves 11 had a depth of 1.1 mm. The drain grooves 11 have a bottom with a downwardly concave circular-arc cross section.

Figure 6:
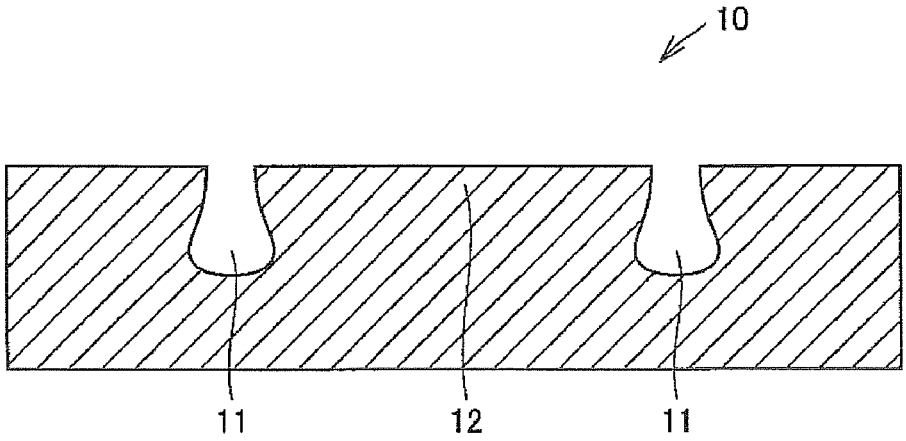
FIG. 6 is an illustrative cross-sectional view showing a pressed state of the press belt shown in FIG. 5.

When a pressure of 6 MPa was applied from above to the press belt 10 of FIG. 5, the lands 12 are squashed and swell sideways as shown in FIG. 6, significantly reducing the transverse sectional area of the drain grooves 11.

Figure 7:
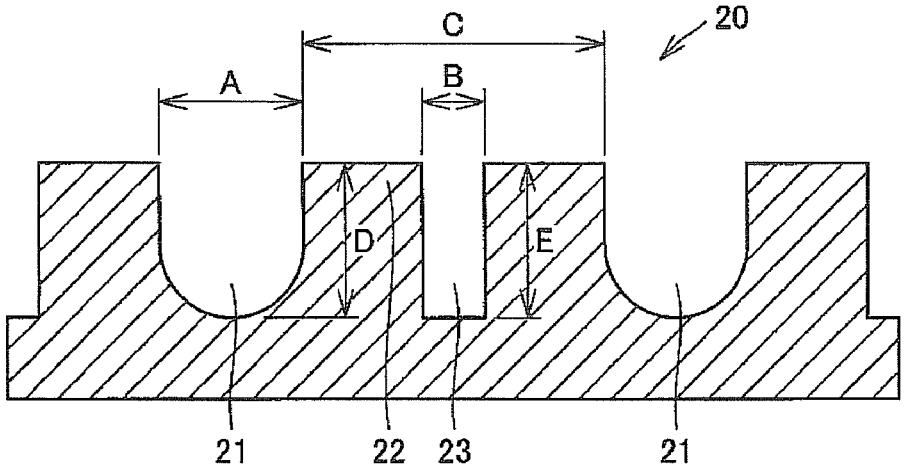
FIG. 7 is an illustrative cross-sectional view of a press belt according to an embodiment of the present invention.

FIG. 7 is a cross-sectional view of a papermaking press belt 20 according to an embodiment of the present invention. The press belt 20 is made of polyurethane having a durometer hardness of A93, and has a multiplicity of drain grooves 21 extending along a belt travel direction, a plurality of lands 22 each located between adjacent drain grooves 21, and auxiliary grooves 23 located in each land 22 and extending along the belt travel direction. The transverse sectional area of each auxiliary groove 23 is smaller than that of each drain groove 21.

The auxiliary grooves 23 of the press belt 20 of the embodiment shown in FIG. 7 have such a shape that tends to be deformed under pressure, in order to suppress deformation of the drain grooves 21. Since the auxiliary grooves 23 are deformed under pressure to absorb a flow stress applied to the lands 22, deformation of the drain grooves 21 is suppressed, and an excellent draining property is maintained.

The dimensional relation between the parts, the groove shape, and the like need to be considered in order to facilitate deformation of the auxiliary grooves 23. In the embodiment shown in FIG. 7, the drain grooves 21 have a bottom with a downwardly concave circular-arc cross section, and the auxiliary grooves 23 have a bottom with a rectangular cross section. Provided that A is the width dimension of the drain grooves 21, B is the width dimension of the auxiliary grooves 23, C is the width dimension of the lands 22, D is the depth of the drain grooves 21, and E is the depth of the auxiliary grooves 23, these values were as follows.

A=1.0 mm
B=0.4 mm
C=2.2 mm
D=1.1 mm
E=1.1 mm

The width dimension ratio B/A of the auxiliary groove 23 to the drain groove 21 is 0.4. The width dimension ratio B/C of the auxiliary groove 23 to the land 22 is 0.18. The depth ratio E/D of the auxiliary groove 23 to the drain groove 21 is 1.0.

Figure 8:
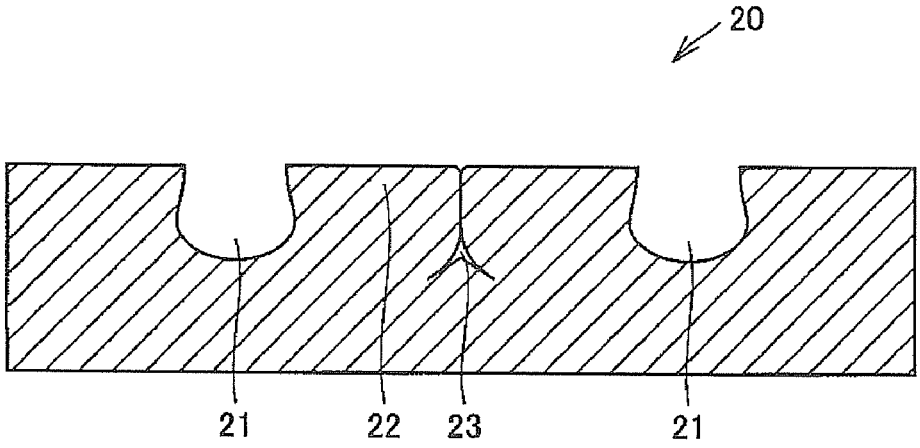
FIG. 8 is an illustrative cross-sectional view showing a pressed state of the press belt shown in FIG. 7.

It was confirmed that, when a pressure of 6 MPa was applied from above to the press belt 20 of FIG. 7, the auxiliary grooves 23 were deformed to absorb a flow stress applied to the lands 22 as shown in FIG. 8, and deformation of the drain grooves 21 was reduced. Thus, the press belt 20 of the embodiment shown in FIG. 7 suppresses deformation of the drain grooves 21, and provides excellent water squeezing performance.

According to many pressing tests using various dimensional ratios of the parts, it was confirmed that a preferred B/A value was 0.3 to 0.8, a preferred B/C value was 0.15 to 0.35, and a preferred E/D value was 0.6 to 1.4 as an embodiment which facilitates deformation of the auxiliary grooves 23.

If the ratio B/A is less than 0.3, the auxiliary grooves 23 are closed in the early stage of the pressing operation, thereby reducing the effect of suppressing deformation of the drain grooves 21. If the ratio B/A exceeds 0.8, on the other hand, the surface area of the lands 22 receiving the load becomes too small, and the load is concentrated on the small area, thereby significantly deforming the lands 22, and also deforming the drain grooves 21.

If the ratio B/C is less than 0.15, the effect of suppressing deformation of the drain grooves 21 by deformation of the auxiliary grooves 23 is reduced. If the ratio B/C exceeds 0.35, on the other hand, the surface area of the lands 22 receiving the load becomes too small, thereby causing a problem similar to that described above.

In order to suppress deformation of the drain grooves 21 along the whole length in a depth direction of the drain grooves 21, it is desirable to make the depth of the auxiliary grooves 23 about the same as that of the drain grooves 21. In view of this, a preferable range of E/D is 0.6 to 1.4.

Preferred groove shapes are as follows. The drain grooves 21 preferably have a bottom with a downwardly concave circular-arc cross section, in order to ensure a relatively large opening area even under pressure. The auxiliary grooves 23 preferably have a bottom having a rectangular cross-section, in order to facilitate deformation of the auxiliary grooves 23 under pressure.

Figure 9:
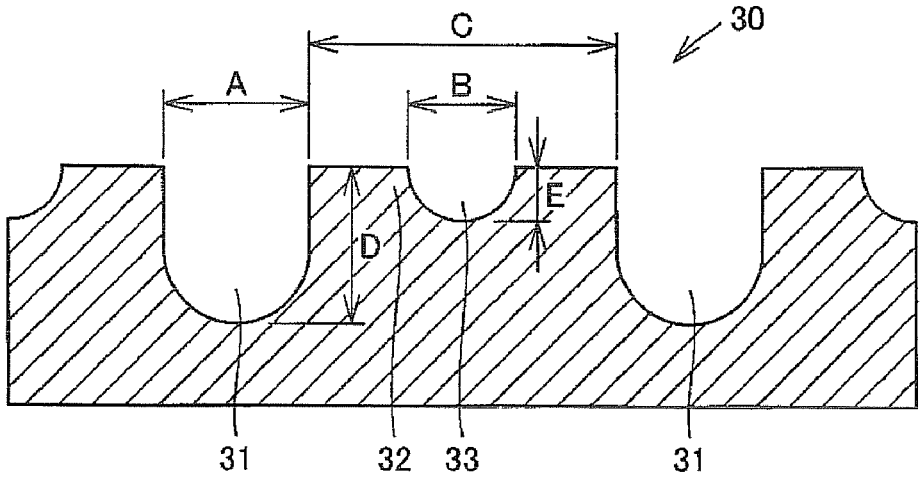
FIG. 9 is an illustrative cross-sectional view of a press belt according to another embodiment of the present invention.

FIG. 9 is a cross-sectional view of a papermaking press belt 30 according to another embodiment of the present invention. The press belt 30 is made of polyurethane having a durometer hardness of A93, and has a multiplicity of drain grooves 31 extending along a belt travel direction, a plurality of lands 32 each located between adjacent drain grooves 31, and auxiliary grooves 33 located on each land 32 and extending along the belt travel direction. The transverse sectional area of each auxiliary groove 33 is smaller than that of each drain groove 31.

The auxiliary grooves 33 of the press belt 30 of the embodiment shown in FIG. 9 have such a shape that can ensure a drain flow path even under pressure, in order to provide a draining function by themselves. Since the auxiliary grooves 33 efficiently squeeze water from a wet paper web and a felt located on a middle part of each land 32 under pressure, the overall water squeezing performance of the press belt 30 is improved.

The dimensional relation between the parts, the groove shape, and the like need to be considered in order to enable the auxiliary grooves 33 to ensure a drain flow path without significant deformation even under pressure. In the embodiment shown in FIG. 9, the drain grooves 31 have a bottom with a downwardly concave circular-arc cross section, and the auxiliary grooves 33 have a semicircular transverse section. Provided that A is the width dimension of the drain grooves 31, B is the width dimension of the auxiliary grooves 33, C is the width dimension of the lands 32, D is the depth of the drain grooves 31, and E is the depth of the auxiliary grooves 33, these values were as follows.

A=1.0 mm
B=0.8 mm
C=2.2 mm
D=1.1 mm
E=0.4 mm

The width dimension ratio B/A of the auxiliary groove 33 to the drain groove 31 is 0.8. The width dimension ratio B/C of the auxiliary groove 33 to the land 32 is 0.36. The depth ratio E/D of the auxiliary groove 33 to the drain groove 31 is 0.36.

Figure 10:
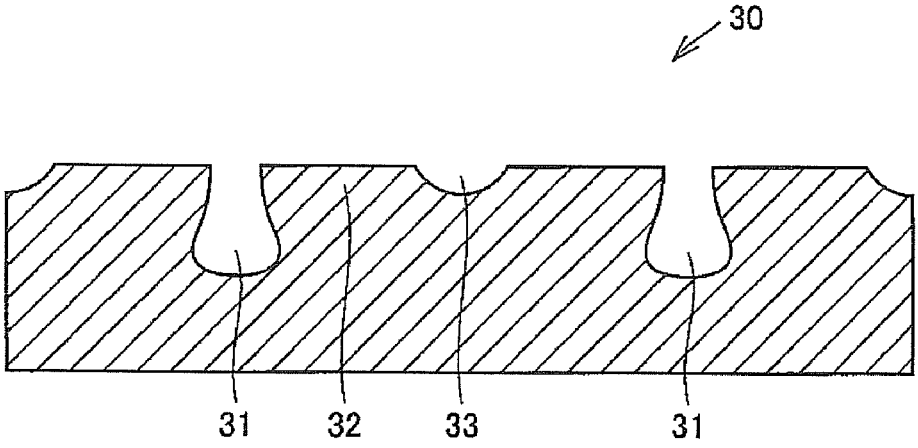
FIG. 10 is an illustrative cross-sectional view showing a pressed state of the press belt shown in FIG. 9.

It was confirmed that, when a pressure of 6 MPa was applied from above to the press belt 30 of FIG. 9, the depth of the auxiliary grooves 33 was reduced, but the drain flow path of the auxiliary grooves 33 was still ensured, as shown in FIG. 10. Thus, the press belt 30 of the embodiment shown in FIG. 9 provides excellent water squeezing performance even approximately in the middle region of each land 32.

According to many pressing tests using various dimensional ratios of the parts, it was confirmed that a preferred B/A value was 0.4 to 1, a preferred B/C value was 0.15 to 0.45, and a preferred E/D value was 0.3 to 0.8 as an embodiment which ensures the drain flow path of the auxiliary grooves 33.

If the ratio B/A is less than 0.4, the water squeezing performance becomes insufficient in the middle region of each land 32. If the ratio B/A exceeds 1, on the other hand, the pressure-receiving surface area of the lands 32 becomes small, and deformation of the lands 32 is increased, thereby significantly reducing the opening area of the drain grooves 31.

If the ratio B/C is less than 0.15, the water squeezing performance becomes insufficient in the middle region of each land 32. If the ratio B/C exceeds 0.45, on the other hand, the pressure-receiving surface area of the lands 32 becomes small, and deformation of the lands 32 is increased, thereby significantly reducing the opening area of the drain grooves 31.

In order for the auxiliary grooves 33 to ensure a drain flow path even under pressure, the auxiliary grooves 33 need to have such a shape that is less likely to be squashed. A preferred shape of the auxiliary grooves 33 which implements this is a wide, shallow groove. Therefore, a preferred ratio E/D is 0.3 to 0.8. If this ratio is less than 0.3, the groove depth is too small to ensure a drain flow path, because the auxiliary grooves 33 are completely squashed in a thickness direction. If this ratio exceeds 0.8, on the other hand, the groove depth is too large to ensure a drain flow path, because the auxiliary grooves 33 are squashed in a width direction.

Preferred groove shapes are as follows. The drain grooves 31 preferably have a bottom with a downwardly concave circular-arc cross section, in order to ensure a relatively large opening area even under pressure. The auxiliary grooves 33 preferably have a semicircular transverse section so that the auxiliary grooves 33 are less likely to be deformed even under pressure.

The embodiment shown in FIGS. 7 and 8 aims to suppress deformation of the drain grooves 21 by actively deforming the auxiliary grooves 23 and absorbing a flow stress applied to the lands 22. The embodiment shown in FIGS. 9 and 10 aims to add a draining function to the auxiliary grooves 33 by preventing the auxiliary grooves 33 from being squashed even under pressure.

Figure 11:
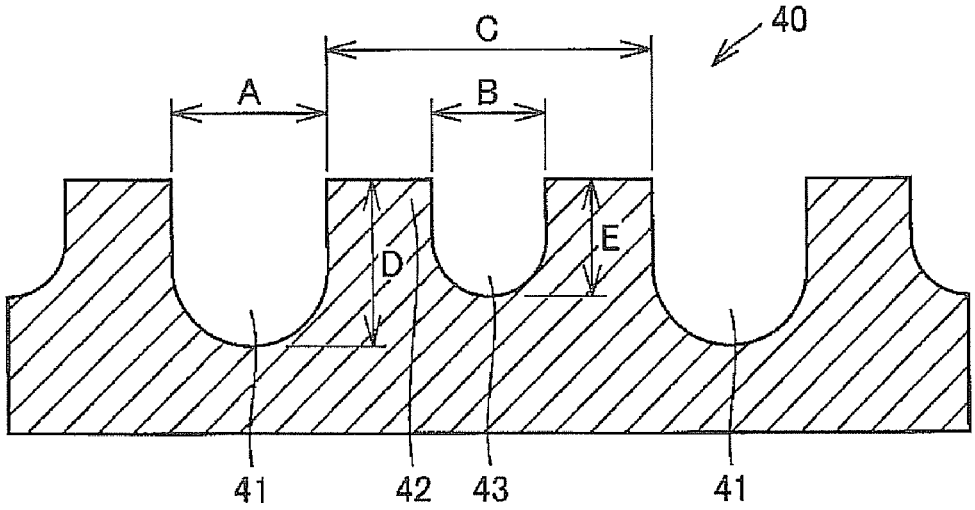
FIG. 11 is an illustrative cross-sectional view of a press belt according to a further embodiment of the present invention.
Figure 12:
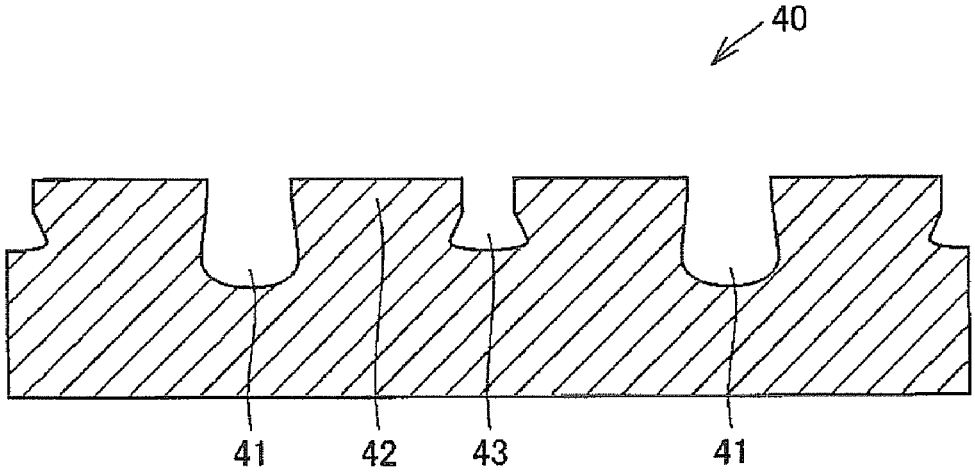
FIG. 12 is an illustrative cross-sectional view showing a pressed state of the press belt shown in FIG. 11.

An embodiment shown in FIGS. 11 and 12 aims to add a draining function to the auxiliary grooves themselves, while suppressing deformation of the drain grooves by deforming the auxiliary grooves.

A press belt 40 shown in FIGS. 11 and 12 is made of polyurethane having a durometer hardness of A93, and has a multiplicity of drain grooves 41 extending along a belt travel direction, a plurality of lands 42 each located between adjacent drain grooves 41, and auxiliary grooves 43 located on each land 42 and extending along the belt travel direction. The transverse sectional area of each auxiliary groove 43 is smaller than that of each drain groove 41.

The dimensional relation between the parts, the groove shape, and the like need to be considered in order to facilitate deformation of the auxiliary grooves 43 and to add a draining function to the auxiliary grooves 43. In the embodiment shown in FIG. 11, the drain grooves 41 have a bottom with a downwardly concave circular-arc cross section, and the auxiliary grooves 43 also have a bottom with a downwardly concave circular-arc cross section. Provided that A is the width dimension of the drain grooves 41, B is the width dimension of the auxiliary grooves 43, C is the width dimension of the lands 42, D is the depth of the drain grooves 41, and E is the depth of the auxiliary grooves 43, these values were as follows.

A=1.0 mm
B=0.6 mm
C=2.2 mm
D=1.1 mm
E=0.8 mm

The width dimension ratio B/A of the auxiliary groove 43 to the drain groove 41 is 0.6. The width dimension ratio B/C of the auxiliary groove 43 to the land 42 is 0.27. The depth ratio E/D of the auxiliary groove 43 to the drain groove 41 is 0.73.

It was confirmed that, when a pressure of 6 MPa was applied from above to the press belt 40 of FIG. 11, the auxiliary grooves 43 were deformed to absorb a flow stress applied to the lands 42 as shown in FIG. 12, and deformation of the drain grooves 41 was reduced. It was also confirmed that the deformed auxiliary grooves 43 still maintained a shape ensuring a drain flow path, and thus, had an excellent draining function. Note that, in the press belt of FIG. 11, since the auxiliary grooves 43 have a bottom with a circular-arc cross section, a risk of generating cracks in the bottom of the auxiliary grooves 43 can be avoided as compared to the press belt of FIG. 7.

The press belt of the present invention is not limited to the form in which one auxiliary groove 23, 33, 43 is provided in each land 22, 32, 42 as shown in FIGS. 7, 9, and 11. For example, an auxiliary groove may be provided in every other land, or a plurality of auxiliary grooves may be provided in one land. Alternatively, auxiliary grooves having different shapes may be combined. The drain grooves may have any known shape such as a rectangular cross section, in addition to the drain grooves having a bottom with a circular-arc cross section.

Although the embodiments of the present invention were described above with reference to the figures, the present invention is not limited to the illustrated embodiments. Various modifications and variations can be made to the above illustrated embodiments within the same scope as, or an equivalent scope to, the present invention.

INDUSTRIAL APPLICABILITY

The present invention can be advantageously used as a papermaking press belt having excellent water squeezing performance.

The invention claimed is:

1. A papermaking shoe press belt having a rotating endless shape, comprising:

a multiplicity of drain grooves extending along a belt travel direction;

a multiplicity of lands located between adjacent ones of said drain grooves and extending along said belt travel direction; and a multiplicity of auxiliary grooves located on said lands and extending along said belt travel direction, wherein a transverse sectional area of each auxiliary groove is smaller than that of each drain groove, and said auxiliary grooves each have a bottom with a rectangular cross section configured to be deformed under pressure, in order to suppress deformation of said drain grooves.

2. The shoe press belt according to claim 1, wherein provided that A is a width dimension of said drain grooves, and B is a width dimension of said auxiliary grooves, a relation of $0.3 \leqq B/A \leqq 0.8$ is satisfied.

3. The shoe press belt according to claim 1, wherein provided that B is a width dimension of said auxiliary grooves, and C is a width dimension of said lands, a relation of $0.15 \leqq B/C \leqq 0.35$ is satisfied.

4. The shoe press belt according to claim 1, wherein provided that D is a depth of said drain grooves, and E is a depth of said auxiliary grooves, a relation of $0.6 \leqq E/D \leqq 1.4$ is satisfied.

5. A papermaking shoe press belt having a rotating endless shape, comprising:

a multiplicity of drain grooves extending along a belt travel direction;

a multiplicity of lands located between adjacent ones of said drain grooves and extending along said belt travel direction; and a multiplicity of auxiliary grooves located on said lands and extending along said belt travel direction, wherein a transverse sectional area of each auxiliary groove is smaller than that of each drain groove, and said auxiliary grooves each have a semicircular transverse section to form a drain flow path even under pressure, in order to provide a draining function.

6. The shoe press belt according to claim 5, wherein provided that A is a width dimension of said drain grooves, and B is a width dimension of said auxiliary grooves, a relation of $0.4 \leqq B/A \leqq 1$ is satisfied.

7. The shoe press belt according to claim 5, wherein provided that B is a width dimension of said auxiliary grooves, and C is a width dimension of said lands, a relation of $0.15 \leqq B/C \leqq 0.45$ is satisfied.

8. The shoe press belt according to claim 5, wherein provided that D is a depth of said drain grooves, and E is a depth of said auxiliary grooves, a relation of $0.3 \leqq E/D \leqq 0.8$ is satisfied.

9. The shoe press belt according to claim 5, wherein said auxiliary grooves each have a bottom with a downwardly concave circular-arc cross section.

10. The shoe press belt according to claim 5, wherein said drain grooves each have a bottom with a downwardly concave circular-arc cross section.

* * * * *